US005309689A

United States Patent [19]

Croissant

[11] Patent Number: 5,309,689

[45] Date of Patent: May 10, 1994

[54] SLIDE ON COVER FOR FRAMING SYSTEM

[75] Inventor: Bruce A. Croissant, Alpharetta, Ga.

[73] Assignee: Kawneer Company, Inc., Norcross, Ga.

[21] Appl. No.: 902,934

[22] Filed: Jun. 23, 1992

[51] Int. Cl.[5] ..... E04H 1/00

[52] U.S. Cl. ..... 52/235; 52/466

[58] Field of Search ..... 52/235, 463, 464, 466, 52/461, 400, 729, 730

[56] References Cited

U.S. PATENT DOCUMENTS 3,886,676 6/1975 Alfonso ..... 52/468 X 4,021,987 5/1977 Schnebel et al. ..... 52/235 X

FOREIGN PATENT DOCUMENTS 326085 1/1958 Switzerland ..... 52/466

OTHER PUBLICATIONS

Kawneer 1600 Wall Shear Block, Kawneer Architectural Detail Manual, p. F1(5) (Kawneer Company, Inc., Norcross, Georgia) (1987).

Kawneer 3000 IB, Kawneer Architectural Detail Manual, p. F5(11) (Kawneer Company. Inc., Norcross, Georgia) (1987).

Kawneer 8000 Wall, Kawneer Architectural Detail Manual, p. F7(8) (Kawneer Company. Inc., Norcross, Georgia) (1987).

*Primary Examiner*—Carl D. Friedman

*Assistant Examiner*—Creighton Smith

*Attorney, Agent, or Firm*—Jones & Askew

[57] ABSTRACT

A framing system is disclosed which includes a frame member and a slide on cover. The frame member has an interior portion, an exterior portion, and at least one glazing pocket defined between the interior and exterior portions, the glazing pocket being configured to receive a lateral edge of a glazing panel therewithin. The cover is configured to engage the exterior portion of the frame member and has a gasket mounting means thereon configured to engage a glazing gasket for bearing against an exterior marginal edge of a glazing panel received within the glazing pocket. When a glazing gasket engages the gasket mounting means and bears against an exterior marginal edge of a glazing panel received within the glazing pocket, it exerts an outward force on the cover which biases the cover into snug engagement with the exterior portion of the frame member so as to secure the cover with respect to the frame member.

10 Claims, 2 Drawing Sheets

SLIDE ON COVER FOR FRAMING SYSTEM

TECHNICAL FIELD

The present invention relates generally to framing systems for buildings and relates more specifically to framing systems comprising decorative covers for frame members.

BACKGROUND OF THE INVENTION

Framing systems are known which include frame members arranged in a grid-like pattern for accommodating glazing panels. The frame members include a main interior portion which provides structural integrity and an exterior portion which defines glazing pockets for receiving the lateral edges of glazing panels. The frame members further typically include mounting means, such as flanges or channels, associated with mutually facing portions of the glazing pockets for mounting gaskets which engage the margins of the glazing panels to weatherseal the structure.

In certain applications it is desirable to provide a decorative cover for the exposed portion of the frame member visible from the exterior. Since the cover is provided primarily for aesthetic purposes, it is desirable to provide a cover which can be mounted to the underlying frame member without the need for exposed fasteners. One widely used type of prior art decorative cover is a snap-on cover which snaps onto the exterior portion of the frame member. The snap-on cover includes a pair of mutually opposed, rearward extending legs having inwardly projecting flanges formed thereon which engage corresponding grooves in the frame member. The cover is applied to the frame member by simply pressing the cover onto the frame member. As the legs slide onto the frame member, they are deflected outwardly, and as the flanges are brought into correspondence with the grooves on the frame member, the legs snap inwardly to engage the flanges with the grooves.

While acceptable for many applications, prior art snap-on covers suffer certain limitations which may render them unsuitable for certain applications. Since secure mounting of the snap-on cover depends upon the elasticity of the legs to bring the flanges into secure engagement with the grooves on the frame member, care must be taken that the legs are not deformed beyond their elastic limit, or yield point, as the cover is installed. Since the extent to which the legs can deflect without permanent deformation depends in large part upon the length of the legs, the cover must necessarily comprise legs which are sufficiently long to accommodate the required deflection. Consequently, snap-on covers must have a certain minimum depth which may be deeper than is aesthetically desired, and "shallow profile" covers are not possible. In addition, for those applications in which it is desired to keep the depth of the cover at or near such minimum depth, design and manufacturing tolerances, not only of the cover but also of the frame member, must be closely maintained to ensure that the legs can accommodate the degree of deflection required for snap-on installation without exceeding their elastic limit. Further, installation demands extra care, since pressing the snap-on cover onto the frame member at even a slight angle from perpendicular may bend the short legs beyond their elastic limits.

SUMMARY OF THE INVENTION

Stated generally, the framing system of the present invention comprises a cover which presents a very shallow profile. The cover does not depend upon resilient legs to maintain a secure engagement with the frame member, and the potential for damaging the cover by bending the legs beyond their elastic limit during the installation process is therefore eliminated. Further, proper fit of the cover onto the frame member can be achieved without the close design and manufacturing tolerances required by prior art covers. Also, the cover is installed in a manner which provides ease of installation and virtually eliminates the possibility that the cover will be damaged during installation.

Stated somewhat more specifically, the present invention comprises a framing system which includes a frame member and a cover. The frame member has an interior portion, an exterior portion, and at least one glazing pocket defined between the interior and exterior portions, the glazing pocket being configured to receive a lateral edge of a glazing panel therewithin. The cover is configured to engage the exterior portion of the frame member and has a gasket mounting means thereon configured to engage a glazing gasket for bearing against an exterior marginal edge of a glazing panel received within the glazing pocket. When a glazing gasket engages the gasket mounting means and bears against an exterior marginal edge of a glazing panel received within the glazing pocket, it exerts an outward force on the cover which biases the cover into snug engagement with the exterior portion of the frame member so as to secure the cover with respect to the frame member.

Thus, it is an object of the present invention to provide an improved framing system with decorative cover.

It is another object of the present invention to provide a framing system which comprises a cover member having a shallow profile.

It is a further object of the present invention to provide a cover member for a framing system which cover member is not dependent upon the elasticity of relatively fragile leg members to maintain the cover member in secure engagement with the frame member.

Another object of the present invention is to provide a cover member for a framing system which is not dependent upon close design and manufacturing tolerances for proper fit.

Still another object of the present invention is to provide a cover member which is easily installed and which does not require significant care during installation to prevent damage to the cover member.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
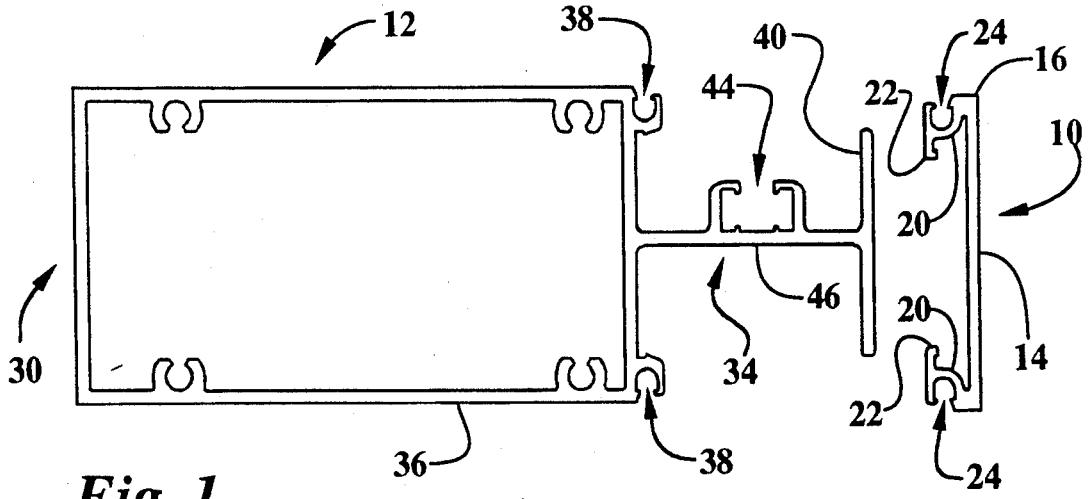
FIG. 1 is a top view of a vertical frame member and slide-on cover according to the present invention.
Figure 2:
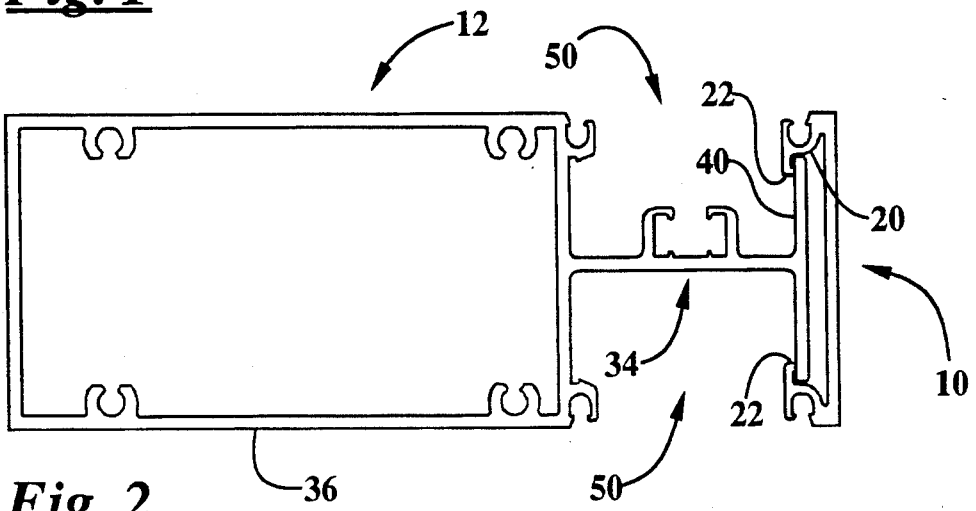
FIG. 2 is a top view of the vertical frame member and slide-on cover of FIG. 1 depicting the cover mounted to the frame member.
Figure 3:
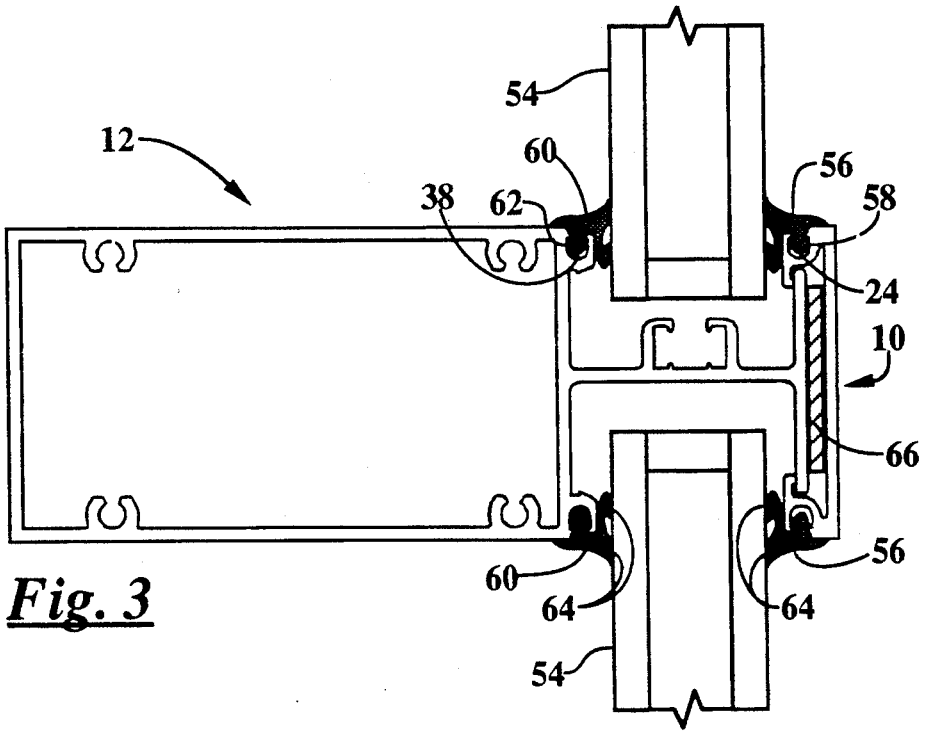
FIG. 3 is a top view of the assembly of FIG. 2 with glazing panels and associated gaskets mounted thereto.

Referring now in more detail to the drawings, in which like numerals indicate like elements throughout the several views, FIGS. 1–3 show a cover member 10 and an intermediate vertical frame member 12 according to the present invention. Referring first to FIG. 1, the cover 10 is an elongated extrusion of indeterminate length. The cover 10 includes an elongated exterior panel 14 having opposing lateral edges 16, 18. Legs 20 extend rearward, or interiorly, along each of the lateral edges 16, 18. Each of the legs 20 includes an inwardly projecting flange 22 formed at its rearward edge. Each leg 20 further defines a transversely opening gasket groove or reglet 24.

The intermediate vertical frame member 12 is an elongated extrusion of indeterminate length and has a major axis of elongation in a direction perpendicular to the drawing sheet. The vertical frame member 12 has a minor axis of elongation 28 and includes an interior portion 30 and an external portion 32 connected by a web 34. The internal portion 30 comprises a structural tube 36 which provides structural rigidity to the frame member 12. Outwardly facing glazing reglets 38 are formed at the forward corners of the structural tube 36.

The external portion 32 of the vertical frame member 12 comprises a transverse flange 40 connected to the structural tube 36 by the web 34. The web 34 includes a pour/debridge channel 44 formed thereon which provides the option of thermally isolating the interior and exterior portions 30, 32 of the vertical frame member 12. The vertical frame member 12 will most often be used with the web 34 intact and without the thermal break installed. However, if it is desired to "break" the frame member 12 thermally, an insulating thermoplastic material in liquid state is poured into the channel 44. When the thermoplastic material has hardened, the "bridge" 46 at the base of the channel 44 is removed. The interior and exterior portions 30, 32 of the frame member 12 are thereafter held together by the thermoplastic insulating material. Such thermal break channels are well known and are disclosed in more detail, for example, in U.S. Pat. No. 4,619,097, which patent is incorporated herein by reference.

Referring now to FIG. 2, the cover 10 is shown mounted to the transverse flange 40 of the vertical frame member 12. The inwardly projecting flanges 22 at the rearward edges of the legs 20 of the cover 10 fit around the lateral edges of the transverse flange 40 to retain the cover in place. Also shown in FIG. 2, glazing pockets 50 are defined between the structural tube 36 and the transverse flange 40 of the vertical frame member 12 on either side of the web 34.

FIG. 3 shows a vertical frame member assembly 52 comprising a vertical frame member 12 with glazing panels 54 installed within the glazing pockets 50. The vertical edges of the glazing panels 54 are received within the glazing pockets 50. Exterior glazing gaskets 56 have head portions 58 which engage the reglets 24 on the cover 10. Interior glazing gaskets 60 have head portions 62 which engage the reglets 38 on the frame member 12. Each of the interior and exterior glazing gaskets 56, 60 has a sealing portion 64 which sealingly engages a confronting marginal surface of a corresponding glazing panel 54. A shim 66 is positioned between the cover 10 and the flange 40, for reasons which will become apparent as the assembly of the framing system is explained below.

Figure 4:
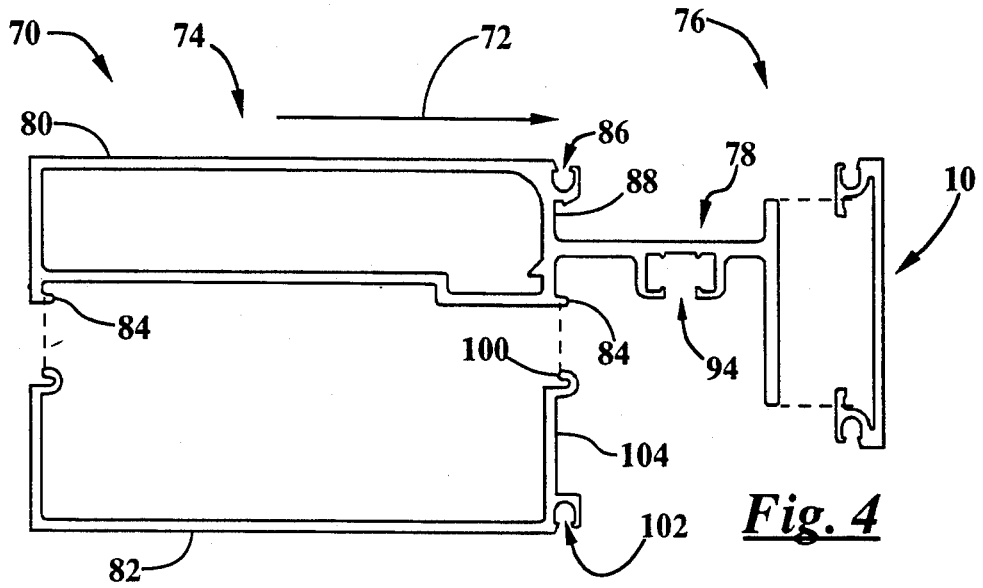
FIG. 4 is a side view of a horizontal frame member and slide-on cover according to the present invention.
Figure 5:
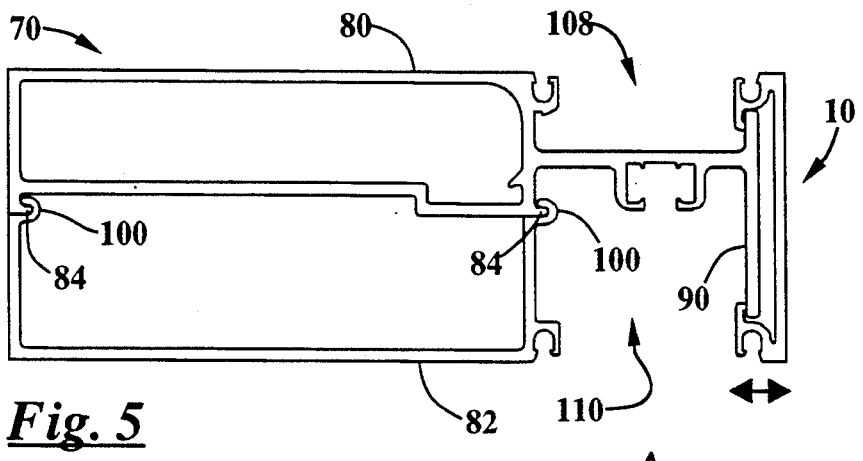
FIG. 5 is a side view of the horizontal frame member and slide-on cover of FIG. 4 depicting the cover mounted to the frame member.
Figure 6:
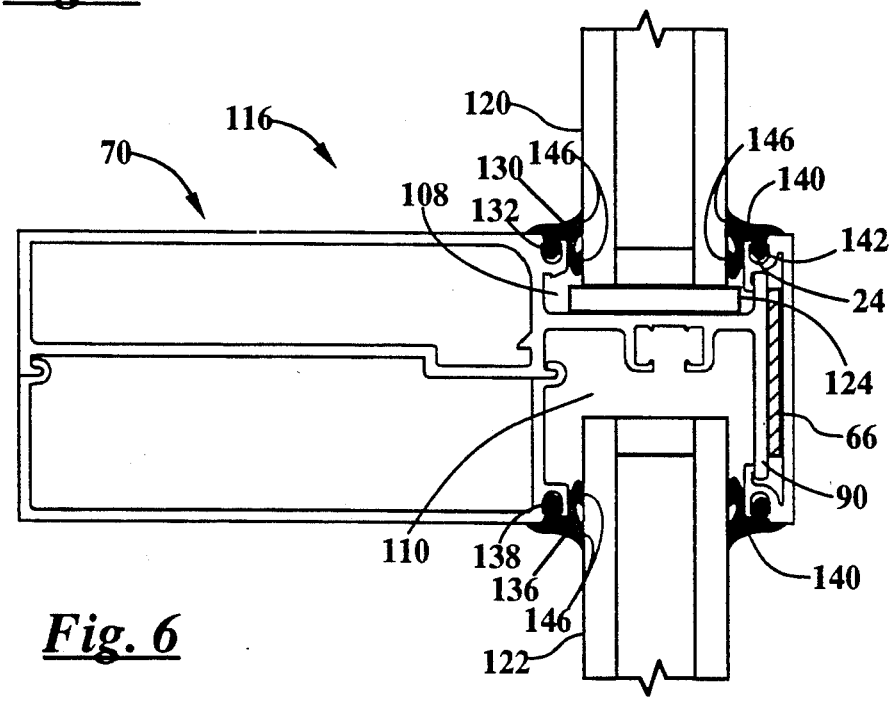
FIG. 6 is a side view of the assembly of FIG. 5 with glazing panels and associated gaskets mounted thereto.

FIGS. 4–6 show an intermediate horizontal frame member 70 for use with the cover 10 according to the present invention. Referring first to FIG. 4, the intermediate horizontal frame member 70 is an elongated extrusion of indeterminate length and has a major axis of elongation in a direction perpendicular to the drawing sheet. The horizontal frame member 70 has a minor axis of elongation 72 and includes an interior portion 74 and an external portion 76 connected by a web 78. The internal portion 74 comprises a structural tube 80 and a glass stop 82. The structural tube 80 provides structural rigidity to the horizontal frame member 70 and includes a pair of flanges 84 defined on its periphery. On the side of the structural tube 80 opposite the flanges 84, the structural tube has a reglet 86 formed at its forward edge 88. The external portion 76 of the horizontal frame member 70 comprises a transverse flange 90 connected to the structural tube 80 by the web 78. The web 78 includes a pour/debridge channel 94 formed thereon which provides the option of thermally isolating the interior and exterior portions 74, 76 of the horizontal frame member 70, in the same manner as hereinabove explained with respect to the pour/debridge channel 44 of the vertical frame member 12.

The glass stop 82 includes a pair of clips 100 which engage the corresponding pair of flanges 84 on the structural tube 80 to clip the glass stop 82 to the structural tube. The glass stop 82 further includes a reglet 102 disposed on its forwardmost face 104.

FIG. 5 shows the glass stop 82 assembled onto the structural tube 80, with the clips 100 of the glass stop engaging the flanges 84 of the structural tube. In addition, the cover 10 is assembled onto the transverse flange 90 of the horizontal frame member 70. The cover 10 loosely engages the transverse flange 90 of the horizontal frame member 70 and slides freely along the direction of elongation of the frame member. Opposed upper and lower glazing pockets 108, 110 are defined between the interior and exterior portions 74, 76 of the horizontal frame member 70 on either side of the web 78.

FIG. 6 shows a horizontal frame member assembly 116 comprising a horizontal frame member 70 with adjacent upper and lower glazing panels 120, 122 installed within the glazing pockets 108, 110. A setting block 124 is positioned within the upper glazing pocket 108 and rests on the web 78. The bottom edge of the upper glazing panel 120 rests on this setting block 124. The top edge of the lower glazing panel 122 is positioned within the lower glazing pocket 110. A first interior glazing gasket 130 has a head portion 132 which engages the reglet 86 at the forward edge 88 of the structural tube. A second interior glazing gasket 136 has a head portion 138 which engages the reglet 102 on the forwardmost face 104 of the glass top 82. Each of a pair of exterior glazing gaskets 140 has a head portion 142 which engages a reglet 24 of the cover 10. The interior and exterior glazing gaskets 130, 136, and 140 all have sealing portions 146 which sealingly engage a confronting marginal surface of a corresponding glazing panel 120 or 122. A shim 66 is positioned between the cover 10 and the flange 90, for reasons which will become apparent as the assembly of the framing system is explained below.

Assembly of a framing system comprising vertical and horizontal frame member assemblies 52, 116 will now be explained. To assemble a vertical frame member assembly 52 according to the present invention, a cover 10 is installed onto a vertical frame member 12 by placing the cover end-to-end with the frame member, aligning the lateral edges of the transverse flange 40 of the frame member within the opposing channels of the cover, and longitudinally sliding the cover with respect to the frame member. When the cover 10 is properly located along the length of the vertical frame member 12, shims 66 are inserted between the interior surface of the cover 10 and the front face of the transverse flange 40 to wedge the cover outward. The inwardly projecting flanges 22 of the cover are thereby wedged tightly against the rear face of the transverse flange 40 to prevent the cover 10 from sliding relative to the frame member 12.

The horizontal frame member assemblies 116 are erected in a similar manner. First, a cover 10 is installed onto the transverse flange 90 of the horizontal frame member 70 by placing the cover end-to-end with the frame member, aligning the lateral edges of the transverse flange within the opposing channels of the cover, and longitudinally sliding the cover with respect to the frame member. When the cover 10 is properly located along the length of the horizontal frame member 70, shims 66 are inserted between the interior surface of the cover 10 and the front face of the transverse flange 90 to wedge the cover outward. The inwardly projecting flanges 22 of the cover are thereby wedged tightly against the rear face of the transverse flange 90 to prevent the cover 10 from sliding relative to the horizontal frame member 70.

The vertical and horizontal frame assemblies 52, 116 are then erected and glazed in a conventional manner. When the edges of the glazing panels have been positioned within the corresponding glazing pockets of the respective vertical and horizontal frame members 52, 116, the glass stop 82 is mounted to the structural tube 80 by engaging the clips 100 of the glass stop with the flanges 84 of the structural tube. Next, the glazing gaskets 56, 60, 130, 136, and 140 are installed in the corresponding reglets. The installation of the resilient outer glazing gaskets 56, 140 into the reglets on the edges of the covers 10 and bearing against a marginal portion of the outer face of the confronting glazing panel biases the covers 10 outward. The covers are thus wedged tightly against the transverse flanges 40, 90. Thus, the act of glazing the panels longitudinally fixes the covers 10 with respect to their associated frame members.

Finally, it will be understood that the preferred embodiment has been disclosed by way of example, and that other modifications may occur to those skilled in the art without departing from the scope and spirit of the appended claims.

What is claimed is:

1. A framing system comprising:

a frame member having a longitudinal axis, an interior portion, an exterior portion, and at least one glazing pocket defined between said interior and exterior portions, said glazing pocket being configured to receive a lateral edge of a glazing panel therewithin; and a cover having a longitudinal axis and being configured to engage said exterior portion of said frame member by relatively sliding said cover and said frame member along their respective longitudinal axes, said cover having gasket mounting means disposed on a lateral face thereof and configured to engage a glazing gasket for bearing against an exterior marginal face of a glazing panel received within said glazing pocket;

whereby a glazing gasket which engages said gasket mounting means and bears against an exterior marginal edge of a glazing panel received within said glazing pocket exerts an outward force on said cover which biases said cover into snug engagement with said exterior portion of said frame member, thereby to secure said cover with respect to said frame member.

2. The framing system of claim 1, wherein said cover comprises a pair of interiorly extending legs having inwardly projecting flanges formed on the interior ends thereof which engage cooperating portions of said exterior portion of said frame member.

3. The framing system of claim 2, wherein said cover and said frame member each comprise a longitudinal axis, and wherein said legs are sufficiently short that lateral deflection of said legs to engage said cover with said exterior portion of said frame member will exceed the elastic limit of said legs, whereby said cover can only be engaged with said exterior portion of said frame member by relatively sliding said cover and said frame member along their respective longitudinal axes.

4. A framing system comprising:

a frame member having an interior portion, an exterior portion, and at least one glazing pocket defined between said interior and exterior portions;

a glazing panel having a lateral edge thereof received within said glazing pocket;

a cover configured to engage said exterior portion of said frame member, said cover having transversely facing gasket mounting means associated therewith; and a resilient gasket mounted to said transversely facing gasket mounting means of said cover and bearing against an exterior marginal face of said glazing panel received within said glazing pocket;

whereby said resilient gasket bearing against said exterior marginal edge of said glazing panel exerts an outward force on said cover which biases said cover into snug engagement with said exterior portion of said frame member, thereby to secure said cover with respect to said frame member.

5. The framing system of claim 4, wherein said cover and said frame member each comprise a longitudinal axis, and wherein said cover engages said exterior portion of said frame member by relatively sliding said cover and said frame member along their respective longitudinal axes.

6. The framing system of claim 4, wherein said cover comprises a pair of interiorly extending legs having inwardly projecting flanges formed on the interior ends thereof which engage cooperating portions of said exterior portion of said frame member.

7. The framing system of claim 6, wherein said cover and said frame member each comprise a longitudinal axis, and wherein said legs are sufficiently short that lateral deflection of said legs to engage said cover with said exterior portion of said frame member will exceed the elastic limit of said legs, whereby said cover can be engaged with said exterior portion of said frame member only by relatively sliding said cover and said frame member along their respective longitudinal axes.

8. A framing system comprising:

a frame member having a longitudinal axis, an interior portion, an exterior portion, and at least one glazing pocket defined between said interior and exterior portions, said glazing pocket being configured to receive a lateral edge of a glazing panel therewithin; and a cover having a longitudinal axis and being configured to engage said exterior portion of said frame member by relatively sliding said cover and said frame member along their respective longitudinal axes, said cover having transversely facing gasket mounting means disposed thereon configured to engage a glazing gasket for bearing against an exterior marginal face of a glazing panel received within said glazing pocket;

whereby a glazing gasket which engages said transversely facing gasket mounting means and bears against an exterior marginal edge of a glazing panel received within said glazing pocket exerts an outward force on said cover which biases said cover into snug engagement with said exterior portion of said frame member, thereby to secure said cover with respect to said frame member.

9. The framing system of claim 8, wherein said cover comprises a pair of interiorly extending legs having inwardly projecting flanges formed on the interior ends thereof which engage cooperating portions of said exterior portion of said frame member.

10. The framing system of claim 9, wherein said cover and said frame member each comprise a longitudinal axis, and wherein said legs are sufficiently short that lateral deflection of said legs to engage said cover with said exterior portion of said frame member will exceed the elastic limit of said legs, whereby said cover can only be engaged with said exterior portion of said frame member by relatively sliding said cover and said frame member along their respective longitudinal axes.

* * * * *